US006418371B1

(12) United States Patent
Arnold

(10) Patent No.: US 6,418,371 B1
(45) Date of Patent: Jul. 9, 2002

(54) TRAFFIC GUIDANCE SYSTEM

(75) Inventor: Jörg Arnold, Heidelberg (DE)

(73) Assignee: Mitsubishi International GmbH, Dusseldorf (DE)

( * ) Notice: Subject to any disclaimer, the term of this patent is extended or adjusted under 35 U.S.C. 154(b) by 0 days.

(21) Appl. No.: 09/622,972

(22) PCT Filed: Sep. 16, 1998

(86) PCT No.: PCT/DE98/02739

§ 371 (c)(1),
(2), (4) Date: Aug. 24, 2000

(87) PCT Pub. No.: WO99/44185

PCT Pub. Date: Sep. 2, 1999

(30) Foreign Application Priority Data

Feb. 27, 1998 (DE) ..... 198 08 158
Mar. 6, 1998 (DE) ..... 198 09 475

(51) Int. Cl.[7] ..... G08G 1/09
(52) U.S. Cl. ..... 701/117; 340/905; 340/988
(58) Field of Search ..... 701/117, 200; 341/905, 902, 907, 995, 904, 988

(56) References Cited

U.S. PATENT DOCUMENTS 4,515,994 A * 5/1985 Bolle et al. ..... 455/556
5,214,793 A * 5/1993 Conway et al. ..... 455/500
5,633,629 A * 5/1997 Hochstein ..... 340/907
5,699,056 A * 12/1997 Yoshida ..... 340/905
5,812,069 A * 9/1998 Albrecht et al. ..... 340/905
6,157,321 A * 12/2000 Ricci ..... 340/902

FOREIGN PATENT DOCUMENTS

EP 0 720 137 A2 7/1996

OTHER PUBLICATIONS

*Universal vehicle information system*, M. H. Sodeikat, 1141 Ingenieurs de l'Automobile, No. 687, Mars 1994, pp. 38–40, Garches, FR, abstract.
*Freeway Traffic Data Prediction Using Neural Networks*, C. Taylor et al., IEEE, 1995, pp. 225–230.
*Individual Communication Function of RACS; Road Automobile Communication System*, R. Fukai et al., IEEE 1989, pp. 206–213.

* cited by examiner

*Primary Examiner*—William A. Cuchlinski, Jr.
*Assistant Examiner*—Marthe Y. Marc-Coleman
(74) *Attorney, Agent, or Firm*—Alston & Bird LLP

(57) ABSTRACT

A traffic guidance system for controlling, guiding and/or optimizing traffic movements, wherein a sensor is provided for detecting the momentary traffic situation, is characterized having in mind an effective control of traffic movements, even in a heavy traffic volume, in that the sensor comprises a radio receiver, and/or a receiver for optical signals, and/or a receiver for acoustical signals for radio signals, and/or optical signals, and/or acoustical signals emitted by road users.

15 Claims, 1 Drawing Sheet

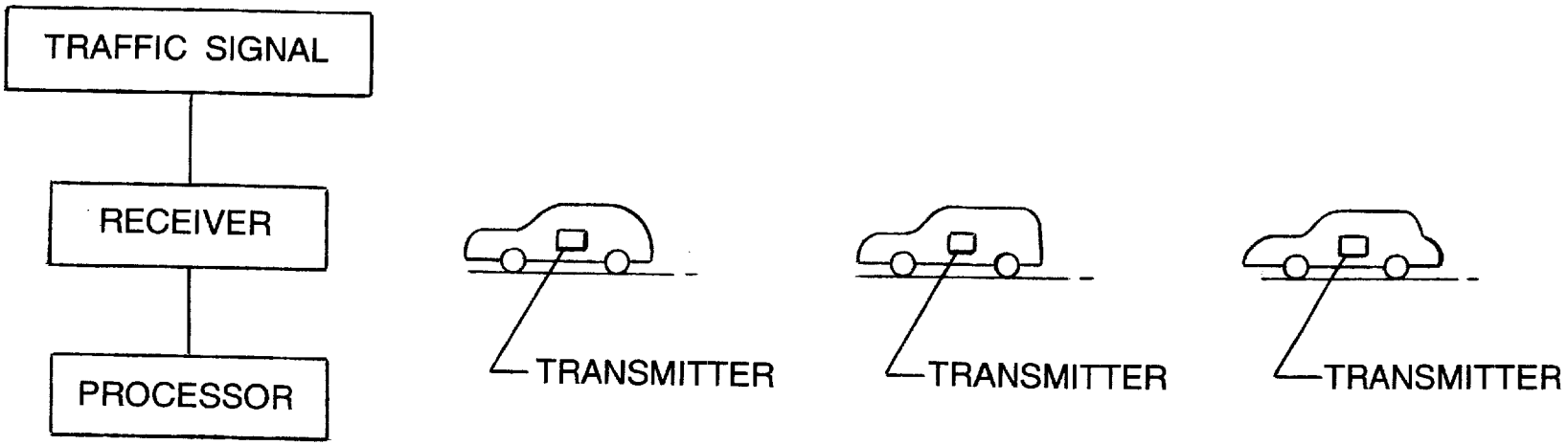
TRAFFIC SIGNAL
RECEIVER
PROCESSOR
TRANSMITTER
TRANSMITTER
TRANSMITTER

TRAFFIC GUIDANCE SYSTEM

BACKGROUND OF THE INVENTION

The invention relates to a traffic guidance system for controlling, guiding and/or optimizing traffic movements, wherein a sensor is provided for detecting the momentary traffic situation.

Traffic guidance systems of the kind under discussion are known from practice. For example, a light signal system, whose signal sequence is controlled by automobiles traveling over a magnetic induction loop, already represents a small-scale traffic guidance system, wherein the magnetic induction loop serves as a sensor.

Furthermore, variable speed limit signs are known from practice, wherein the sensor arrangement may be formed by acoustical or optical ultrasonic motion signalers, or infrared motion signalers, or even by light barriers.

In dense traffic networks, there exists the general problem that in most cases the traffic flow in a certain location is dependent on the traffic flow in other locations. If the traffic flow is to be improved as a whole, it will therefore be necessary to influence the traffic likewise in these other locations. In this instance, traffic guidance systems or traffic signs will have to be coordinated as a whole and be interdependent in a certain way.

Normally, these interdependencies are to be determined by expensive, mathematical examinations and simulations, and must then be applied to the coordination of the traffic signs. To this end different steps are necessary. The traffic volume or the traffic situation and the traffic conditions must be detected via sensors in certain locations. These results are then used as a decision basis in a logic process, which supplies instructions for controlling the traffic signs.

The foregoing control of a light signal system at an individual traffic node or intersection, or at a road junction represents the simplest case of application. At such a traffic intersection, all light signal systems are controlled in dependence on one another. In the costliest application, groups of many traffic signs are switched interdependently. In this process, a plurality of nodes or intersections is involved. For such a networking, it is common to use traffic guidance computers, which are provided in a central traffic routing point. For larger or denser traffic spaces, the mathematical treatment or process control of the traffic control is so expensive that only large computers are still in a position of processing the resultant enormous quantities of traffic data and to perform the control within the scope of mathematical traffic models that have so far been very expensive.

The central traffic control in traffic routing points necessitates numerous and extensive telecommunications links between the traffic signs and a traffic routing point. As is known from the traffic theory, an independent control of individual traffic signs at connected traffic intersections or sections of a traffic route may however barely improve the traffic situation. In the past, is has been possible to significantly improve the interrelated traffic situation of major traffic spaces—for example, in cities—only with the aid of the described, expensive control with central traffic routing points.

For an effective traffic control, it continues to be necessary that nearly every vehicle in the traffic be considered in the control. Problematic is the use of sensors as have been employed so far in the form of induction loops that are to be crossed, motion signalers, or light barriers, in that their recording capacity is restricted to a narrowly predetermined spatial area, namely, for example, the arrangement area of the induction loop that is to be crossed, or the detectable solid angle of the motion signalers or the range covered by the light barrier. On the other hand, the known sensors are problematic, in that they permit a reliable detection of automobiles only in moving traffic. However, if heavy traffic has already caused a jam, in which the automobiles are stopped, both induction loops and motion signalers, as well as a light barrier will not be able to detect a further increase in the number of automobiles in the observed traffic space or in the jam. The same situation will result, when vehicles are stopped at a light signal system.

From this follows that in particular at times of an already jamming traffic, it is not possible to receive exact data concerning the number of vehicles involved. Consequently, in most cases, the inaccurate or incomplete data will not permit a precise traffic control. Instead, the limits of conventional traffic guidance systems are reached with a therefrom-resulting collapse of the traffic.

It is therefore the object of the present invention to describe a traffic guidance system of the initially described kind, which enables an effective control of traffic movements even in the case of a heavy traffic volume.

SUMMARY OF THE INVENTION

The above and other objects and advantages of the invention are achieved by the provision of a traffic guidance system for controlling, guiding, and/or optimizing traffic movements along a roadway, comprising a transmitter carried by each of a plurality of roadway users for actively transmitting a signal irrespective of the state of movement of the user. Also, a sensor is mounted at a fixed location along the roadway for receiving the signals from the transmitters and processing the signals in a decentralized manner at the location where they are received to determine the number of participating roadway users and enable an effective control of traffic movements. Preferably, the traffic guidance system of the invention is configured such that the sensor comprises a radio receiver, and/or a receiver for optical signals, and/or a receiver for acoustical signals emitted by the roadway users.

To begin with, it has been recognized in accordance with the invention that a traffic guidance system is not limited to conventional types of detection. In a further manner according to the invention, the sensor is designed and constructed such that it comprises a radio receiver, and/or a receiver for optical signals, and/or a receiver for acoustical signals, for radio signals, and/or optical signals, and/or acoustical signals, which are actively emitted by road users. With that, limits of conventional types of detection are overcome, since detection of automobiles or other road users is not dependent on their state of movement. Instead, the detection principle of the present invention makes it possible to reliably detect all vehicles, even when same are stopped at a light signal system or in a jam. Furthermore, the spatially narrow detection range, as exists, for example, in the case of a light barrier system, is considerably extended. In a simple manner, it is possible to predetermine the detected spatial area respectively by the configuration of the receiver or the spatial reception coverage.

Consequently, the traffic guidance system of the present invention makes it possible to detect substantially more exact data concerning the number of participating road users. From this results a considerably more representative data base for a traffic guidance system than has been possible with conventional traffic guidance systems. In particular, an accurate data acquisition is possible even in a stopped traffic.

Therefore, the traffic guidance system of the present invention describes a system, which enables an effective control of traffic movements, even in a heavy traffic volume.

As regards a particular simple configuration of the traffic guidance system, it would be possible to associate the sensor to a traffic sign, preferably a light signal system. In a cost-favorable manner, this would make separate sensor carriers unnecessary, such as, for example, carrier poles.

To ensure a reliable detection of the road users, it would be possible to associate to the road users radio transmitters, and/or optical signal transmitters, and/or acoustical signal transmitters for emitting the radio signals and/or optical signals and/or acoustical signals. In this instance, it would be possible to associate the transmitters to the vehicles of the road users and/or to arrange same thereon. This would realize a link between transmitter and vehicle, so that the transmitter will always be ready for use, when the respective vehicle is used. With that, the road user would not have to see to it that the transmitter is taken along each time the vehicle is used.

As regards a particularly inconspicuous and compact installation of the radio transmitters, and/or optical signal transmitters, and/or acoustical signal transmitters, it would be possible to integrate the transmitters as subassemblies or as modules in telecommunications equipment, telemetric devices, radio receivers, or other electric equipment. In this connection, an integration in mobile telephones is possible. For example, known mobile telephones transmit radio signals at regular intervals for their own localization by the network operator. Within the scope of the traffic guidance system according to the invention, it would be possible to use these radio signals for detecting the road user. As a whole, it would be possible to provide the radio signals, and/or optical signals, and/or acoustical signals as periodic transmitting pulses with predeterminable transmitting frequencies.

As regards a particularly comfortable operation of the traffic guidance system, it would be possible to associate to the sensors radio transmitters, and/or optical signal transmitters, and/or acoustical signal transmitters, processing units with memories, and switching devices. This would permit receiving and processing traffic data or the momentary traffic situation for controlling the traffic signs, for example, a plurality of light signal systems of a traffic node, directly in situ, at the respective traffic node. In this instance, the traffic data for controlling the traffic could be collected and processed totally decentralized through the sensors, preferably the radio receivers, and/or receivers for optical signals, and/or receivers for acoustical signals.

In particular with respect to a very reliable operation of the traffic guidance system, it would be possible to design and construct the radio receivers, and/or receivers for optical signals, and/or receivers for acoustical signals for purposes of detecting and preferably storing signal pulse rates and their changes and/or the received power and its change. Preferably, it would be possible to register regularly transmitted transmitting pulses of the road users moving past a traffic sign, or stopping at a traffic sign, or approaching a traffic sign from a distance. Processing could occur by an internal comparison at each traffic sign, or by a comparison between interdependent traffic signs in a traffic node. To this end, it would be possible to configure the transmitters and receivers of traffic signs, which are to be switched interdependently, in particular traffic signs of a traffic node or a section of a traffic route, in particular for a wireless communication with one another. Processing could occur at certain time intervals or continuously.

In the traffic control, it would also be possible to consider in a particularly effective manner, the respective speeds of the road users and/or their group speed. This could occur, for example, by a radio transmission, an optical or an acoustical transmission of the momentary speed value of the road user to the radio receiver, and/or receiver for optical signals, and/or receiver for acoustical signals of the sensor. On the other hand, it would be possible to design and construct the radio receivers, and/or receivers for optical signals, and/or receivers for acoustical signals for detecting and preferably storing the Doppler shift of the signal frequencies of the moving road users and, thus, the state of movement of the road users. This would enable the sensor to determine the speed of the road users automatically. In this instance, the road users would not have to be equipped for transmitting their speed value by means of the radio link, optical connection, or acoustical connection.

To realize a particularly versatile and comprehensive traffic guidance system of a major traffic space, it would be possible that predeterminable groups of interdependent traffic signs, preferably groups, which can be associated to different traffic nodes or sections of traffic routes, are networked by the traffic flow on the traffic routes, and/or are mutually influenceable. With that, it would be possible to transmit by means of the road users themselves data from one group of traffic signs to another group or other groups of traffic signs. Further signal transmitting devices would then not be needed, and the entire radio communications volume and/or optical and/or acoustical signal volume could be limited to spatially narrow areas, for example, an area closely defined around the observed group.

In particular to this end, it would be possible to associate to the radio transmitters, and/or optical signal transmitters, and/or acoustical signal transmitters, radio receivers, and/or receivers for optical signals, and/or receivers for acoustical signals, processing units with memories, and switching devices. Lastly, it would be possible to design and construct the radio transmitters, and/or optical signal transmitters, and/or acoustical signal transmitters, and radio receivers, and/or receivers for optical signals, and/or receivers for acoustical signals, which are associated to the road users and/or traffic signs, as a radio relay, and/or optical signal relay, and/or acoustical signal relay. This would enable a data transmission, and/or a transmission of switching signals in any desired manner via traffic signs and road users.

As regards a particularly sensitive traffic control, the signals of different groups of road users could differ, preferably necessitated by a situation. In this connection, it would be possible to classify, for example, public means of transportation as preferred road users based on their specific radio signals, and/or optical signals, and/or acoustical signals, and to guide same accordingly with preference. Should the respective vehicles in use as means of public transportation be no longer in use, it would be possible to modify the signals accordingly, so that it is no longer necessary to give these vehicles a priority position in the traffic control.

As an alternative or in addition thereto, it would be possible to influence the predeterminable switching behavior of the traffic signs via radio signals, and/or optical signals, and/or acoustical signals. In particular in this connection, one has in mind a priority signal by, for example, squad cars of the police, fire trucks, or ambulances. This would allow to realize a safe passage of such privileged vehicles through intersections, since it would be possible to stop crossing traffic automatically by means of correspondingly controlled traffic signs.

A further, comfortable and effective configuration of the traffic guidance system would permit switching traffic signs based on a comparison of received traffic data and/or received weather data. In this instance, the control of the traffic could be made dependent on individual weather situations. To this end, the radio receivers, and/or receivers for optical signals, and/or receivers for acoustical signals could be designed and constructed in a particularly reliable and practical manner for detecting and preferably storing the field attenuation of the radio signals, and/or optical signals, and/or acoustical signals of preferably the road users and, thus, the weather situation, in particular the snow, rain, or fog situation. Depending on the characteristic damping of the signals, it is possible to determine, for example, the density of snow, rain, and fog. On the one hand, the signals could be emitted by the road users, who are in the traffic with vehicles, and on the other hand by road users, who are on their way with bicycles or even on foot. For picking up the weather situation, the signals need not absolutely originate from automobile drivers, but could also come from other road users, whose signals could differ from the signals of the automobile drivers. Thus, the pickup and evaluation of the weather situation is independent of the traffic volume formed by automobiles.

In an effective manner, it would be possible to influence the switching behavior of the traffic signs by an optimization process. In this connection, the optimization process could be a method of varying the parameters that influence the switching process. Parameters could include the traffic volume with a facultative consideration of the weather situation.

As regards a particularly fast control process, the switching of one traffic sign, which is dependent on another traffic sign, could be effected by the other traffic sign. This would make it possible to transmit in particular fast priority signals without undergoing a processing procedure.

As a whole, the traffic guidance system could be constructed as a neural traffic guidance network system. In this instance, the usual operating principles of a neural network are applied.

A further, particularly advantageous development would permit constructing the traffic guidance system in addition as a navigation system for road users. To this end, it would be possible to design and construct the radio transmitters, and/or optical signal transmitters, and/or acoustical signal transmitters, and radio receivers, and/or receivers for optical signals, and/or receivers for acoustical signals of traffic signs for communicating with radio transmitters, and/or optical signal transmitters, and/or acoustical signal transmitters, and radio receivers, and/or receivers for optical signals, and/or receivers for acoustical signals of road users, and vice versa. On the other hand, a pure navigation system without traffic control would likewise be possible by picking up traffic data. In this instance, it would be possible to realize the functions described in the following.

Programmable information via geographic and/or topological characteristics of the traffic routes, in particular an information about traffic destinations of the road users could be stored decentralized in a memory. In this connection, it would be of special advantage that not every road user would have to carry along geographic and/or topological data, which are normally stored on a compact disk.

In a particularly simple manner, it would be possible to associate the memory for the information to a traffic sign. This would allow a constant recall by a requesting road user within the scope of an only short signal connection path.

The information about traffic destinations could be stored in groups, which are associated to the directions of traffic destinations. In this instance, the road user would be referred to the direction of his desired destination. In this process, further possible destinations located in this direction would be passed on to the road user for advertising purposes. In this connection, one has in mind business enterprises, such as, for example, retail businesses, which can be included in the information memory against a certain payment. Likewise, it would be possible to make a request by the road user chargeable, so that the one or both last-mentioned measures would realize a financing of the operation and actualization of the memory. Thus, a further traffic guidance function would be realized by means of the navigation system.

The results, which are present in the case of detecting the weather situation by the sensors, could likewise be made available to a road user upon request. Thus, the traffic guidance system could be constructed in addition as a weather information system. Likewise, this request could be made chargeable. In this connection and in the case of the navigation system, the request via a mobile telephone presents itself in particular. In this instance, its network operator could charge the fees.

A regards a comprehensive use of the traffic guidance system, it would be possible to make available an electronic device, which is characterized by a radio receiver, and/or receiver for optical signals, and/or receiver for acoustical signals for the radio signals, and/or optical signals, and/or acoustical signals, which are emitted by the road users. In a simple manner, such devices could be used as supplemental components for traffic signs already in use.

Furthermore, it would also be possible to make available electronic devices, which are characterized on the part of the road user by a radio transmitter, and/or optical signal transmitter, and/or acoustical signal transmitter for emitting radio signals, and/or optical signals, and/or acoustical signals for the traffic guidance system. With that, it would also be possible to realize an ideal possibility of retrofitting automobiles.

BRIEF DESCRIPTION OF THE DRAWING

For a further understanding of the above-described traffic guidance system, the following will describe in greater detail some particularly essential aspects of the traffic guidance system, with reference to the accompanying drawing, which schematically illustrates the traffic guidance system of the present invention.

DETAILED DESCRIPTION OF THE PREFERRED EMBODIMENTS

Referring more particularly to the drawing, a plurality of automobiles are illustrated as being aligned along a roadway. Each automobile carries a transmitter as further described herein, and the automobiles are positioned in front of a traffic signal which includes a receiver and processor as described herein.

The foregoing description relates in particular to the road traffic. However, the invention can also be applied to other traffic areas with means of traffic or transportation in traffic flows or traffic networks, which are capable of being developed in accordance with the invention.

In the road traffic, it would be possible to take into account different groups of road users separately from one another, for example, by their kind, such as pedestrians or automobiles, by the type of vehicle, such as passenger cars or trucks, buses and rail systems, or by their function, such as passenger service, freight service, private traffic or commercial traffic, individual transportation or public transportation, transportation services, cleaning services, clearing services, police services, emergency services, rescue services, etc. For example, the use of special signals would allow police and rescue services to make traffic signs clear the passage on their way.

At certain traffic times, it would be possible to give to the individual passenger traffic or to the public passenger traffic priority over the commercial freight traffic. This would be advantageous in particular for professional commuters in rush hours, or it could direct truck traffic through cities during traffic times that are more acceptable to residents on the traffic routes.

The configuration of the radio transmitters, and/or optical signal transmitters, and/or acoustical signal transmitters, and radio receivers, and/or receivers for optical signals, and or receivers for acoustical systems as relays could be used to give by means of a signal to the road users information, for the time being from or via a traffic sign, about the traffic situation on the particular traffic route, or in the section of the traffic route, or in the traffic node. These signals could be transmitted by the road users repeatedly and thus to the next traffic sign, until new information is received. To this end, the road users could transmit the information permanently, or they could transmit the information only when they detect a signal receiver of a traffic sign. To this end, the signal receivers could make themselves noticed by emitting radio signals, and/or optical signals, and/or acoustical signals.

This would have the advantage that, for controlling the traffic signs, it would also be possible to consider other data than only the number of entering, exiting, waiting, or passing road users. For example, it would be possible to transmit information about intersecting traffic or other competing traffic to other locations, for example, to preceding traffic nodes in this traffic route or in other traffic routes. Likewise, it would be possible to transmit as information, an integral information or an accumulated information about the course of the previous traffic on the traffic route of the road user. This could be, for example, a short information which informs that there is a congestion at the previously passed traffic node. Accordingly, the traffic signs would be able to guide traffic in a major traffic space to the extent that the traffic node with the congestion is bypassed.

In particular, in the case of a relay-type transmission of information by means of the road users, it would be possible to realize a greater possibility of coupling or networking as regards individual sections of the traffic route and/or individual traffic nodes. This could be used to give at different traffic times preference, for example, to main traffic routes over other traffic routes.

Furthermore, it would be possible to transmit from the transmitters of the traffic signs to approaching, but still removed road users, information that indicates the traffic situation at the next traffic node or in the next section of the traffic route. In particular, this information could comprise a behavior request to the road users, for example, a most favorable possible moving speed. With that, the intelligent control of the traffic signs could be assisted at traffic nodes or in sections of traffic routes for purposes of further optimizing the traffic flow.

The transmitting powers could be adjusted so low that only traffic signs responsible for one traffic route section or traffic node are able to pick up signals of the road users from this section, thereby leaving uninfluenced other, further removed traffic signs of possibly other traffic route sections or other traffic nodes, which are to remain unaffected. For purposes of being able to selectively register the traffic on individual, different, and certain traffic routes, or the traffic in a certain direction of movement, it would be possible to equip the transmitting and receiving systems for transmitting and receiving the road user signals and for transmitting information to the road users, with antennas, which are capable of transmitting and receiving only signals in or from the particular traffic route, or in or from a certain direction of the particular traffic route. Particularly suitable in this case are, for example, horn antennas for high signal frequencies in the microwave range.

The use of antennas with certain, limited solid angles for transmitting or receiving may serve in particular the purpose of receiving further information about the traffic situation. For example, when the signals of the road users are separately detected from one direction or from two directions of a traffic route, it will be possible to make a statement on the state of movement of the road users via the Doppler shift of the receiving frequencies or from splitting the particular receiving frequency band. In particular, it is possible to recognize a stopped or a moving traffic, and it is possible to determine even the moving speed of the road users.

This results in the advantage that the traffic guidance system of the present invention is capable of recognizing congested situations, and of transporting and spreading this information via the road users. With that, it is possible to influence the selfcontrol of the traffic guidance system. Furthermore, a traffic monitoring, for example, a speed check, could automatically occur at the particular traffic signs.

As regards the determination of the weather situation by damping the radio signals, and/or optical signals, and/or acoustical signals, it would be possible to select the transmitting frequency such that the signals of the road users are subjected to a particularly high attenuation, for example, by water molecules. In this instance, it is presumed that the transmitting power of the transmitters of the road users is constant and standardized. A corresponding field attenuation of the radio signals, and/or optical signals, and/or acoustical signals will then allow to conclude the presence of rain, fog, or a threat of snow and ice.

In the simplest manner, it would be possible to determine the field attenuation by standardizing the integrally registered receiving power of the transmission pulses by means of the integrally registered transmission pulse rate. As a result, it would then be possible to compare the average transmitting power of a road user after the field attenuation of its radiation, at the receiving location with the same theoretical quantity without field attenuation, which is known because of the standard transmitting power of the road users. From the comparison, it is possible to determine due to the exponential distance-dependence of the receiving power, the field attenuation and, consequently, the average density of rain or fog. A more exact method would include the variables.

Suitable frequency ranges are, for example, ranges, in which water absorption resonances or high scattering cross sections for the radiation lie. These would be, for example, the 24 GHz range and higher radio frequency ranges. In particular, with the use of the traffic guidance system according to the invention for directing the traffic in combination with traffic signs, which regulate, for example, the speed of the traffic, or the ban on passing, or the closing of traffic lanes, significant safety advantages result from considering the weather situation.

In a further development of the traffic guidance system according to the invention, the traffic guiding function could be supplemented with a navigating function for the road users. The memory associated to the sensor could comprise not only traffic data, but also information about traffic routes, for example, directions of approaching traffic route junctions, traffic route nodes, and sections of traffic routes. Furthermore, it would be possible to store predeterminable traffic destinations, for example, certain facilities along the traffic routes, such as, for example, buildings, bridges, tunnels, sights or, for example, commercial facilities, such as stores, plants, banks, restaurants, hotels, cinemas, gas stations, information offices, or public facilities, such as, for example, theaters, casinos, museums, art galleries, churches, sports facilities, swimming pools, zoological gardens, schools, university institutes, parking garages, agencies, government departments, hospitals, health resort grounds, parks, police stations, military facilities, railroad stations, airports, and the like. Within the scope of materials traffic in production plants, it would be possible to store, for example, the position of warehouse sections, storage compartments, processing lines, assembly lines, sorting stations, packing stations, measuring and testing equipment, shipping sections, or the like. It is possible to retrieve this information at each traffic sign of any observed traffic space.

Each road user, who wants to use the navigation aid, indicates his destination to his correspondingly equipped transmitter. This may be the description of the address of the traffic destination. The transmitter will then transmit at regular intervals, or even permanently, or upon reaching a predeterminable distance from a traffic sign, the destination request to the traffic sign, which stores the traffic destinations in groups, if need be. The recognition of the predeterminable distance can occur by signals of the traffic sign. The respective groups may be associated to the traffic directions, in which the road user must move to reach the desired traffic destination.

In reply to the request, the transmitter of the traffic sign transmits to the receiver of the road user, information about the direction or a movement, which the road user must follow at or after the traffic sign. As described above, the directional information in particular may take into account the local traffic situation and local traffic conditions to change a directional instruction as an alternative, for example, for avoiding and bypassing traffic jams or bad weather areas. Furthermore, it is possible to guide visitor traffic to its destination on certain main traffic routes, thereby relieving and quieting from the traffic certain areas of the traffic space, for example, residential areas. For the road user, the invention offers the great advantage of not needing to keep ready geographic map material for the visited traffic space, inasmuch as such material becomes frequently obsolete after a short time because of a change in the traffic network or traffic control, and is therefore possibly unusable. The memories of the traffic signs may however be updated at any time. This could occur, for example, by a radio transmission, and/or optical transmission, and or acoustical transmission to the preferably addressable traffic signs.

The signals for the switching instructions, which are transmitted from one traffic sign to another traffic sign, may differ from the signals of the road users and from those, which are intended for the road users, and they may be transmitted on different transmission channels and with different transmitting frequencies and transmitting methods.

The traffic guidance system may be equipped with a plurality of transmission channels for the switching signals and for the traffic data and the navigational data. To this end, the individual traffic signs and the equipment of the road users may be made addressable. It will then be possible to transmit data concerning the traffic situation, or switching instructions, or navigational data, addressed or directed by a certain transmitting method, for example digitized and coded. As an example for the necessary communication between the traffic signs, it would be possible to use a radio transmission method ("token ring" method). As an embodiment for a radio technological configuration, the radio transmission method could be based on the decentralized radio transmission method, which is disclosed in German Applications 195 35 021.9; 197 20 236.5; 197 26 956.7, and 196 08 846.1.

For purposes of switching the traffic signs, a certain switching behavior is programmably applied to the operational units of the traffic signs, which may be constructed from radio receivers, and/or receivers for optical signals, and/or receivers for acoustical signals, radio transmitters, and/or optical signal transmitters, and/or acoustical signal transmitters, processing units with memory, and switching devices. For example, it would be possible to predetermine the switching behavior in such a manner that it satisfies certain optimization requirements. Accordingly, it would be possible to adjust the switching behavior or the switching parameters, such as switching times, switching frequency, switching duration, etc., so as to minimize as much as possible the rise or the decay, i.e., for example the change in the transmitting pulse rate and absolute strength of the transmitting pulse rate, which is received by the receiver. This would correspond to a traffic flow that is as smooth as possible. In particular, each individual operational unit could orient its switching behavior to traffic data, which are transmitted to all dependent operational units.

This could be, for example, the sum of all registered individual transmitting pulse rates and/or individual changes of the transmitting pulse rates of the individual traffic signs. As a result, all operational units would have available the same data for making a decision, and it would be possible to prevent a competing switching behavior in the individual traffic signs, which leads to an unstable behavior of the traffic control and traffic flow.

This switching behavior could develop itself such that each operational unit finds itself the most favorable adjustment in a "trial-and-error" method, by varying the switching parameters, and tests same in an effect-related manner. One would then have a variation method, wherein each operational unit could vary all switching parameters. The variation of the switching parameters by the individual operational units of the traffic signs or a traffic node could be performed via a predeterminable method. In this method, only as many and certain operational units would vary switching parameters at the same time, or one after the other, as are needed for making the optimization as efficient as possible. To this end, the operational units could again exchange radio data, and/or optical data, and/or acoustical data.

These adjustments of the switching parameters could be roughly predetermined by adjustments, which the operational unit has previously used and noted in similar traffic situations. To this end, it is necessary to store such data about the traffic situation and the switching parameter adjustments applied thereto. For this reason, the operational units of the traffic signs or the group of traffic signs of, for example, a traffic node, in which a mutual switching occurs, are capable of learning.

If an operational unit of a traffic node decides a switching by a logic process, it will transmit switching instructions to certain dependent traffic signs on therefor-determined channels, and switch itself at the same time. The dependent traffic signs will then be switched at the same time. Each traffic sign has the possibility of switching all other dependent traffic signs, for example, of the traffic node. As described above, switching occurs by an optimization process with an optimization basis that is the same for all operational units.

The groups of operational units of the different traffic nodes and the different traffic route sections form together a neural switching network. The operational units of a traffic node or a traffic route section form neural switches (neurons), which are networked themselves by the traffic regulation, and stimulated by the continuous traffic volume or the traffic flow. It can be expected from theoretical examinations that this neural traffic guidance network system automatically optimizes the entire traffic flow in its area. In large traffic spaces, the invention can optimize the traffic situation or the traffic flow by itself without an external traffic management, and solve great, interconnected traffic problems. This results in particular from the fact that the enormous amounts of traffic data, which are required for solving a traffic problem or optimizing the traffic, can be individually collected in all traffic nodes and traffic route sections, totally decentralized and distributed in small amounts, and be directly processed there, and that the entire traffic guidance system as a neural network is capable of generating an approximately identical processing capacity, as is common in conventional large computers.

The advantages of the described traffic guidance system result on the one hand in the economic field and on the other hand in the technical field. The invention permits making available traffic guidance systems with preferably combined navigation and weather alert systems in a substantially more cost-favorable manner as regards basic installation and operation than has been possible until now, since they do not require central traffic guidance equipment with controlling large computers and the necessary operating personnel. Furthermore, no separate telecommunications network is needed for connecting to the traffic sensors and the traffic signs in the traffic routes.

With the invention, it is possible to retrofit existing traffic signs to components of an intelligent traffic guidance system, wherein the required sensors can be equipped with very cost-favorable receivers. Existing traffic signs can be revamped therewith and need not be replaced. Furthermore, it is possible to avoid expensive cable connections in the traffic lanes between the dependent traffic signs, for example, of a traffic node. In particular, it is possible to realize with the traffic guidance system of the present invention a very cost-favorable navigation system, which does not require on the part of the road users, roadway measuring devices, satellite-assisted position measuring devices, visualization components, expensive processor and storage units, and geographic map material in, for example, electronic storage media, thereby making it possible to avoid costs that are connected therewith.

In the technical field, the traffic guidance system of the present invention has created a traffic guidance system that is considerably more flexible than traffic guidance systems of the prior art. It is possible to respond in a flexible manner to different traffic conditions and traffic situations at different times, and to weather conditions in an automatic and self-controlling manner. Furthermore, the system is capable of locally responding to the requirements of individual groups of road users in general or in certain situations. In particular, the system permits integrating in cities the pedestrian traffic—preferably, via mobile telephones—and to direct visitor traffic to its destinations. In addition, the system increases safety of road users in certain exceptional situations, such as, for example, in the case of a special vehicular traffic or in bad weather situations. Such conditions cannot be recognized and controlled flexibly enough by traffic guidance systems of the state of the art. In particular, the invention permits realizing an integrated weather alert system and an integrated navigation system, which can be used via telecommunications equipment, such as, for example, mobile telephones, and thus is available not only to road users, such as automobile drivers, but also to pedestrians. The networking of the system occurs in a particularly simple manner by the moving traffic itself. The latter may even serve as a carrier for further traffic information. This avoids networking via telecommunications equipment.

In the simplest case of including the road users as carriers of the traffic information, it would be possible that sensors with radio receivers, and/or receivers for optical signals, and/or receivers for acoustical signals initially detect the average speed, and/or the traffic volume, and/or the weather situation on a traffic lane in one direction. Should a congested situation or another unfavorable traffic situation develop at this measuring point, it would be possible to transmit the information by the radio receivers, and/or receivers for optical signals, and/or receivers for acoustical signals via the oncoming traffic into the opposite direction, i.e., in the direction, from which the originally observed traffic has come. Operational units of the road users of the oncoming traffic would serve as moving relay stations, which preferably have only a short transmission and reception range, but could transmit, because of their movement and a repeated transmission of the information, the information even over long transmission distances, if need be. This would enable the radio receivers, and/or receivers for optical signals, and/or receivers for acoustical signals of, for example, traffic signs, which are arranged in an area previously passed by the observed traffic before the congestion, to pick up the transmitted data concerning the congested situation or the unfavorable traffic condition, and to reduce, for example, the speed limit value on the traffic signs ahead of the congested area, or to effect a detour of the traffic. This would contribute to dissolving the congestion or to bypassing the unfavorable traffic condition, and to improving the traffic flow. In this instance, it would be possible to determine in particular the group speed of the traffic flowing in one direction.

As an alternative or in addition thereto, it would also be possible that road users of the originally observed traffic are themselves the receivers of the information transmitted by the oncoming traffic concerning the congestion or the unfavorable traffic condition. Thus, the information need not be transmitted to the road users via traffic signs, but can be received directly by an operational unit of the road user, which is arranged, for example, in the automobile. This operational unit is now able to invite the road user to a corresponding reaction—for example, to reducing the speed or changing the travel direction, and/or to trigger such a reaction automatically. The automatic procedure could comprise an engagement in the braking system, in a speed control device, and/or in the position of the accelerator, or it could be considered within a guidance operation of a navigation system.

Conventional traffic guidance systems, for example, radio controlled light signal systems at pedestrian crossings or construction sites, or radio controlled, variable traffic signs, such as, for example, variable speed limit signs are known from practice. However, they are installations, in which only the distance between the central traffic routing point and the traffic sign is overcome by means of a radio transmission, thereby avoiding expensive cable connections.

As a whole, the traffic guidance system of the present invention discloses an alternative, very effective, and highly flexible traffic guidance system for improving the traffic situation in traffic spaces, wherein all traffic-relevant parameters are considered. In this connection the high cost for the installation of conventional traffic guidance system with traffic routing points and telecommunications networks is avoided.

What is claimed is:

1. A traffic guidance system for controlling, guiding, and/or optimizing traffic movements along a roadway, comprising a transmitter carried by each of a plurality of roadway users for actively transmitting a signal irrespective of the state of movement of the user, and a plurality of sensors each mounted at a different fixed location along the roadway for receiving the signals from the transmitters and processing the signals in an entirely decentralized manner at the location where they are received to determine the number of roadway users and to enable an effective control of traffic movements and so as to form a network which is responsive to said signals.

2. The traffic guidance system as defined in claim 1 wherein each transmitter actively transmits a signal selected from the group consisting of a radio signal, an optical signal, an acoustical signal, and combinations thereof.

3. The traffic guidance system as defined in claim 1 wherein each sensor is connected to a traffic light signal.

4. The traffic guidance system as defined in claim 1 the transmitter carried by each user is integrated in an electrical system of the user.

5. The traffic guidance system as defined in claim 1 the transmitter carried by each user transmits pulses of a predetermined frequency.

6. The traffic guidance system as defined in claim 1 wherein each sensor comprises a receiver and a processor for processing the signals and which includes a memory.

7. The traffic guidance system as defined in claim 6 wherein each sensor further comprises a transmitter for communicating with the transmitters of the users.

8. The traffic guidance system as defined in claim 7 wherein the memory of the processor of each sensor includes information concerning the traffic routes and/or roadway facilities which may be transmitted to the users by the transmitter of the associated sensor.

9. The traffic guidance system as defined in claim 1 each sensor is designed and configured for detecting a signal pulse rate and its changes and/or the signal power and its changes.

10. The traffic guidance system as defined in claim 1 wherein each sensor comprises a switching device to permit a plurality of said traffic guidance systems to have wireless communication with one another.

11. The traffic guidance system as defined in claim 1 wherein each sensor is designed and configured for detecting the Doppler shift of the signals so as to indicate the state of movement of the roadway users.

12. The traffic guidance system as defined in claim 1 wherein the transmitters are each designed and configured as a relay to permit data transmission among said sensors.

13. The traffic guidance system as defined in claim 1 wherein the transmitters of different groups of roadway users are designed and configured to emit unique signals to permit a classification of the users.

14. The traffic guidance system as defined in claim 1 wherein the transmitters and/or sensors are designed and configured for detecting weather conditions.

15. The traffic guidance system as defined in claim 1 wherein each sensor is designed and configured for communicating with the transmitters of the users.

* * * * *

UNITED STATES PATENT AND TRADEMARK OFFICE

CERTIFICATE OF CORRECTION

PATENT NO. : 6,418,371 B1
DATED : July 9, 2002
INVENTOR(S) : Arnold

It is certified that error appears in the above-identified patent and that said Letters Patent is hereby corrected as shown below:

Title page,
Item [56], References Cited, FOREIGN PATENT DOCUMENTS, insert the following: -- FR 2 721 717 12/1995 --.
"Fukai" should read -- Fukui --.

Column 13,
Line 35, after "claim 1" insert -- wherein --;
Line 38, after "claim 1" insert -- wherein --.

Column 14,
Line 12, after "claim 1" insert -- wherein --.

Signed and Sealed this

Seventeenth Day of December, 2002

JAMES E. ROGAN
*Director of the United States Patent and Trademark Office*